US006801421B1

(12) United States Patent
Sasse et al.

(10) Patent No.: US 6,801,421 B1
(45) **Date of Patent: *Oct. 5, 2004**

(54) SWITCHABLE FLUX CONTROL FOR HIGH POWER STATIC ELECTROMAGNETIC DEVICES

(75) Inventors: Christian Sasse, Västerås (SE); Mats Leijon, Västerås (SE); Gunnar Russberg, Västerås (SE); Udo Fromm, Västerås (SE); Par Holmberg, Västerås (SE)

(73) Assignee: ABB AB, Vasteras (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/161,992

(22) Filed: Sep. 29, 1998

(51) Int. Cl.[7] ..... H01H 27/00; H01H 27/28

(52) U.S. Cl. ..... 361/268; 361/139; 336/182; 336/212; 174/110 R; 174/102 SC

(58) Field of Search ..... 361/139, 143, 361/146, 147, 148, 166, 167, 268; 336/160, 165, 178, 182, 186, 212; 174/102 SC, 110 R

(56) References Cited

U.S. PATENT DOCUMENTS

| | | | |
|---|---|---|---|
| 295,699 | A | 11/1884 | Smith et al. |
| 681,800 | A | 9/1901 | Lasche |
| 847,008 | A | 3/1907 | Kitsee |
| 1,304,451 | A | 5/1919 | Burnham |
| 1,418,856 | A | 6/1922 | Williamson |
| 1,481,585 | A | 1/1924 | Beard |
| 1,508,456 | A | 9/1924 | Lenz |
| 1,728,915 | A | 9/1929 | Blankenship et al. |
| 1,742,985 | A | 1/1930 | Burnham |
| 1,747,507 | A | 2/1930 | George |
| 1,756,672 | A | 4/1930 | Barr |
| 1,762,775 | A | 6/1930 | Ganz |
| 1,781,308 | A | 11/1930 | Vos |

(List continued on next page.)

FOREIGN PATENT DOCUMENTS

| | | |
|---|---|---|
| AU | 399790 | 7/1995 |
| BE | 565063 | 2/1957 |
| CH | 391071 | 4/1965 |
| CH | 266037 | 10/1965 |
| CH | 534448 | 2/1973 |
| CH | 539328 | 7/1973 |

(List continued on next page.)

OTHER PUBLICATIONS

P. Marti and R. Schuler, "Manufacturing and Testing of Roebel Bars".*

M. Ichihara and F. Fukasawa, "An EHV Bulk Power Transmission Line Made with Low Loss XLPE Cable," Aug. 1992, *Hitachi Cable Review*, No. 11, pp. 3–6.*

*Underground Transmission Systems Reference Book*, 1992 Edition, prepared by Power Technologies, Inc. for Electric Power Research Institute (title page).*

(List continued on next page.)

*Primary Examiner*—Kim Huynh
(74) *Attorney, Agent, or Firm*—Dykema Gossett PLLC

(57) ABSTRACT

A high power static electromagnetic device with a flux path, a main winding and one or more regulation windings surrounding portions of the flux path. A control device is coupled to the flux path for selectively admitting the flux therein. In an exemplary embodiment, multiple flux paths are selectively turned on and off for including and excluding the regulation windings from the circuit. The windings may be formed of a magnetically permeable, field-confining insulating cable.

55 Claims, 4 Drawing Sheets

U.S. PATENT DOCUMENTS

| | | | | |
|---|---|---|---|---|
| 1,861,182 | A | | 5/1932 | Hendey et al. |
| 1,904,885 | A | | 4/1933 | Seeley |
| 1,974,406 | A | | 9/1934 | Apple et al. |
| 2,006,170 | A | | 6/1935 | Juhlin |
| 2,206,856 | A | | 7/1940 | Shearer |
| 2,217,430 | A | | 10/1940 | Baudry |
| 2,241,832 | A | | 5/1941 | Wahlquist |
| 2,251,291 | A | | 8/1941 | Reichelt |
| 2,256,897 | A | | 9/1941 | Davidson et al. |
| 2,295,415 | A | | 9/1942 | Monroe |
| 2,409,893 | A | | 10/1946 | Pendleton et al. |
| 2,415,652 | A | | 2/1947 | Norton |
| 2,424,443 | A | | 7/1947 | Evans |
| 2,436,306 | A | | 2/1948 | Johnson |
| 2,446,999 | A | | 8/1948 | Camilli |
| 2,459,322 | A | | 1/1949 | Johnston |
| 2,462,651 | A | | 2/1949 | Lord |
| 2,498,238 | A | | 2/1950 | Berberich et al. |
| 2,650,350 | A | | 8/1953 | Heath |
| 2,721,905 | A | | 10/1955 | Monroe |
| 2,749,456 | A | | 6/1956 | Luenberger |
| 2,780,771 | A | | 2/1957 | Lee |
| 2,846,599 | A | | 8/1958 | McAdam |
| 2,885,581 | A | | 5/1959 | Pileggi |
| 2,943,242 | A | | 6/1960 | Schaschl et al. |
| 2,947,957 | A | | 8/1960 | Spindler |
| 2,962,679 | A | | 11/1960 | Stratton |
| 2,975,309 | A | | 3/1961 | Seidner |
| 3,014,139 | A | | 12/1961 | Shildneck |
| 3,098,893 | A | | 7/1963 | Pringle et al. |
| 3,130,335 | A | | 4/1964 | Rejda |
| 3,143,269 | A | | 8/1964 | Eldik |
| 3,157,806 | A | | 11/1964 | Wiedemann |
| 3,158,770 | A | | 11/1964 | Coggeshall et al. |
| 3,197,723 | A | | 7/1965 | Dortort |
| 3,268,766 | A | | 8/1966 | Amos |
| 3,304,599 | A | | 2/1967 | Nordin |
| 3,354,331 | A | | 11/1967 | Broeker et al. |
| 3,365,657 | A | | 1/1968 | Webb |
| 3,372,283 | A | | 3/1968 | Jaecklin |
| 3,392,779 | A | | 7/1968 | Tilbrook |
| 3,411,027 | A | | 11/1968 | Rosenberg |
| 3,418,530 | A | | 12/1968 | Cheever |
| 3,435,262 | A | | 3/1969 | Bennett et al. |
| 3,437,858 | A | | 4/1969 | White |
| 3,444,407 | A | | 5/1969 | Yates |
| 3,447,002 | A | | 5/1969 | Ronnevig |
| 3,484,690 | A | | 12/1969 | Wald |
| 3,541,221 | A | | 11/1970 | Aupoix et al. |
| 3,560,777 | A | | 2/1971 | Moeller |
| 3,571,690 | A | | 3/1971 | Lataisa |
| 3,593,123 | A | | 7/1971 | Williamson |
| 3,631,519 | A | * | 12/1971 | Salahshourian ..... 174/73.1 |
| 3,644,662 | A | | 2/1972 | Salahshourian |
| 3,651,244 | A | | 3/1972 | Silver et al. |
| 3,651,402 | A | | 3/1972 | Leffmann |
| 3,660,721 | A | | 5/1972 | Baird |
| 3,666,876 | A | | 5/1972 | Forster |
| 3,670,192 | A | | 6/1972 | Andersson et al. |
| 3,675,056 | A | | 7/1972 | Lenz |
| 3,684,821 | A | | 8/1972 | Miyauchi et al. |
| 3,684,906 | A | | 8/1972 | Lexz |
| 3,699,238 | A | | 10/1972 | Hansen et al. |
| 3,716,652 | A | | 2/1973 | Lusk et al. |
| 3,716,719 | A | | 2/1973 | Angelery et al. |
| 3,727,085 | A | | 4/1973 | Goetz et al. |
| 3,740,600 | A | | 6/1973 | Turley |
| 3,743,867 | A | | 7/1973 | Smith, Jr. |
| 3,746,954 | A | | 7/1973 | Myless et al. |
| 3,758,699 | A | | 9/1973 | Lusk et al. |
| 3,778,891 | A | | 12/1973 | Amasino et al. |
| 3,781,739 | A | | 12/1973 | Meyer |
| 3,792,399 | A | | 2/1974 | McLyman |
| 3,801,843 | A | | 4/1974 | Corman et al. |
| 3,809,933 | A | | 5/1974 | Sugawara et al. |
| 3,881,647 | A | | 5/1975 | Wolfe |
| 3,884,154 | A | | 5/1975 | Marten |
| 3,891,880 | A | | 6/1975 | Britsch |
| 3,902,000 | A | | 8/1975 | Forsyth et al. |
| 3,912,957 | A | | 10/1975 | Reynolds |
| 3,932,779 | A | | 1/1976 | Madsen |
| 3,932,791 | A | | 1/1976 | Oswald |
| 3,943,392 | A | | 3/1976 | Keuper et al. |
| 3,947,278 | A | | 3/1976 | Youtsey |
| 3,965,408 | A | * | 6/1976 | Higuchi et al. ..... 363/75 |
| 3,968,388 | A | | 7/1976 | Lambrecht et al. |
| 3,971,543 | A | | 7/1976 | Shanahan |
| 3,974,314 | A | | 8/1976 | Fuchs |
| 3,993,860 | A | | 11/1976 | Snow et al. |
| 3,995,785 | A | | 12/1976 | Arick et al. |
| 4,001,616 | A | | 1/1977 | Lonseth et al. |
| 4,008,367 | A | | 2/1977 | Sunderhauf |
| 4,008,409 | A | | 2/1977 | Rhudy et al. |
| 4,031,310 | A | | 6/1977 | Jachimowicz |
| 4,039,740 | A | | 8/1977 | Iwata |
| 4,041,431 | A | * | 8/1977 | Enoksen ..... 336/160 |
| 4,047,138 | A | | 9/1977 | Steigerwald |
| 4,064,419 | A | | 12/1977 | Peterson |
| 4,084,307 | A | | 4/1978 | Schultz et al. |
| 4,085,347 | A | | 4/1978 | Lichius |
| 4,088,953 | A | | 5/1978 | Sarian |
| 4,091,138 | A | | 5/1978 | Takagi et al. |
| 4,091,139 | A | | 5/1978 | Quirk |
| 4,099,227 | A | | 7/1978 | Liptak |
| 4,103,075 | A | | 7/1978 | Adam |
| 4,106,069 | A | | 8/1978 | Trautner et al. |
| 4,107,092 | A | | 8/1978 | Carnahan et al. |
| 4,109,098 | A | | 8/1978 | Olsson et al. |
| 4,121,148 | A | | 10/1978 | Platzer |
| 4,132,914 | A | | 1/1979 | Khutoretsky et al. |
| 4,134,036 | A | | 1/1979 | Curtiss |
| 4,134,055 | A | | 1/1979 | Akamatsu |
| 4,134,146 | A | | 1/1979 | Stetson |
| 4,149,101 | A | | 4/1979 | Lesokhin et al. |
| 4,152,615 | A | | 5/1979 | Calfo et al. |
| 4,160,193 | A | | 7/1979 | Richmond |
| 4,164,672 | A | | 8/1979 | Flick |
| 4,164,772 | A | | 8/1979 | Hingorani |
| 4,177,397 | A | | 12/1979 | Lill |
| 4,177,418 | A | * | 12/1979 | Brueckner et al. ..... 323/250 |
| 4,184,186 | A | | 1/1980 | Barkan |
| 4,200,817 | A | | 4/1980 | Bratoljic |
| 4,200,818 | A | | 4/1980 | Ruffing et al. |
| 4,206,434 | A | * | 6/1980 | Hase ..... 336/5 |
| 4,207,427 | A | | 6/1980 | Beretta et al. |
| 4,207,482 | A | | 6/1980 | Neumeyer et al. |
| 4,208,597 | A | | 6/1980 | Mulach et al. |
| 4,229,721 | A | | 10/1980 | Koloczek et al. |
| 4,238,339 | A | | 12/1980 | Khutoretsky et al. |
| 4,239,999 | A | | 12/1980 | Vinokurov et al. |
| 4,245,182 | A | | 1/1981 | Aotsu et al. |
| 4,246,694 | A | | 1/1981 | Raschbichler et al. |
| 4,255,684 | A | | 3/1981 | Mischler et al. |
| 4,258,280 | A | | 3/1981 | Starcevic |
| 4,262,209 | A | | 4/1981 | Berner |
| 4,274,027 | A | | 6/1981 | Higuchi et al. |
| 4,281,264 | A | | 7/1981 | Keim et al. |
| 4,307,311 | A | | 12/1981 | Grozinger |
| 4,308,476 | A | | 12/1981 | Schuler |
| 4,308,575 | A | | 12/1981 | Mase |
| 4,310,966 | A | | 1/1982 | Breitenbach |

4,314,168 A 2/1982 Breitenbach
4,317,001 A 2/1982 Silver et al.
4,320,645 A 3/1982 Stanley
4,321,426 A * 3/1982 Schaeffer et al. ..... 174/34
4,321,518 A 3/1982 Akamatsu
4,330,726 A 5/1982 Albright et al.
4,337,922 A 7/1982 Streiff et al.
4,341,989 A 7/1982 Sandberg et al.
4,347,449 A 8/1982 Beau
4,347,454 A 8/1982 Gellert et al.
4,357,542 A 11/1982 Kirschbaum
4,360,748 A 11/1982 Raschbichler et al.
4,361,723 A 11/1982 Hvizd, Jr. et al.
4,363,612 A 12/1982 Walchhutter
4,365,178 A 12/1982 Lenz
4,367,425 A 1/1983 Mendelsohn et al.
4,367,890 A 1/1983 Spirk
4,368,418 A 1/1983 DeMello et al.
4,369,389 A 1/1983 Lambrecht
4,371,745 A 2/1983 Sakashita
4,384,944 A 5/1983 Silver et al.
4,387,316 A 6/1983 Katsekas
4,401,920 A 8/1983 Taylor et al.
4,403,163 A 9/1983 Rarmerding et al.
4,404,486 A 9/1983 Keim et al.
4,411,710 A 10/1983 Mochizuki et al.
4,421,284 A 12/1983 Pan
4,425,521 A 1/1984 Rosenberry, Jr. et al.
4,426,771 A 1/1984 Wang et al.
4,429,244 A 1/1984 Nikitin et al.
4,431,960 A 2/1984 Zucker
4,432,029 A 2/1984 Lundqvist
4,437,464 A 3/1984 Crow
4,443,725 A 4/1984 Derderian et al.
4,470,884 A 9/1984 Carr
4,473,765 A 9/1984 Butman, Jr. et al.
4,475,075 A 10/1984 Munn
4,477,690 A 10/1984 Nikitin et al.
4,481,438 A 11/1984 Keim
4,484,106 A 11/1984 Taylor et al.
4,488,079 A 12/1984 Dailey et al.
4,490,651 A 12/1984 Taylor et al.
4,503,284 A 3/1985 Minnick et al.
4,508,251 A 4/1985 Harada et al.
4,510,077 A 4/1985 Elton
4,517,471 A 5/1985 Sachs
4,520,287 A 5/1985 Wang et al.
4,523,249 A 6/1985 Arimoto
4,538,131 A 8/1985 Baier et al.
4,546,210 A 10/1985 Akiba et al.
4,551,780 A 11/1985 Canay
4,557,038 A 12/1985 Wcislo et al.
4,560,896 A 12/1985 Vogt et al.
4,565,929 A 1/1986 Baskin et al.
4,571,453 A 2/1986 Takaoka et al.
4,588,916 A 5/1986 Lis
4,590,416 A 5/1986 Porche et al.
4,594,630 A 6/1986 Rabinowitz et al.
4,607,183 A 8/1986 Rieber et al.
4,615,109 A 10/1986 Wcislo et al.
4,615,778 A 10/1986 Elton
4,618,795 A 10/1986 Cooper et al.
4,619,040 A 10/1986 Wang et al.
4,622,116 A 11/1986 Elton et al.
4,633,109 A 12/1986 Feigel
4,650,924 A 3/1987 Kauffman et al.
4,652,963 A 3/1987 Fahlen
4,656,379 A 4/1987 McCarty
4,677,328 A 6/1987 Kumakura
4,687,882 A 8/1987 Stone et al.
4,692,731 A 9/1987 Osinga
4,723,083 A 2/1988 Elton
4,723,104 A 2/1988 Rohatyn
4,724,345 A 2/1988 Elton et al.
4,732,412 A 3/1988 van der Linden et al.
4,737,704 A 4/1988 Kalinnikov et al.
4,745,314 A 5/1988 Nakano
4,761,602 A 8/1988 Leibovich
4,766,365 A * 8/1988 Bolduc et al. ..... 323/308
4,771,168 A 9/1988 Gundersen et al.
4,785,138 A 11/1988 Breitenbach et al.
4,795,933 A 1/1989 Sakai
4,827,172 A 5/1989 Kobayashi
4,845,308 A 7/1989 Womack, Jr. et al.
4,847,747 A 7/1989 Abbondanti
4,853,565 A 8/1989 Elton et al.
4,859,810 A 8/1989 Cloetens et al.
4,859,989 A 8/1989 McPherson
4,860,430 A 8/1989 Raschbichler et al.
4,864,266 A 9/1989 Feather et al.
4,883,230 A 11/1989 Lindstrom
4,890,040 A 12/1989 Gundersen
4,894,284 A 1/1990 Yamanouchi et al.
4,914,386 A 4/1990 Zocholl
4,918,347 A 4/1990 Takaba
4,918,835 A 4/1990 Raschbichler et al.
4,924,342 A 5/1990 Lee
4,926,079 A 5/1990 Niemela et al.
4,942,326 A 7/1990 Butler, III et al.
4,949,001 A 8/1990 Campbell
4,982,147 A 1/1991 Lauw
4,994,952 A * 2/1991 Silva et al. ..... 363/56
4,997,995 A 3/1991 Simmons et al.
5,012,125 A 4/1991 Conway
5,030,813 A * 7/1991 Stanisz ..... 219/116
5,036,165 A 7/1991 Elton et al.
5,036,238 A 7/1991 Tajima
5,066,881 A 11/1991 Elton et al.
5,067,046 A 11/1991 Elton et al.
5,083,360 A 1/1992 Valencic et al.
5,086,246 A 2/1992 Dymond et al.
5,091,609 A 2/1992 Sawada et al.
5,094,703 A 3/1992 Takaoka et al.
5,095,175 A 3/1992 Yoshida et al.
5,097,241 A 3/1992 Smith et al.
5,097,591 A 3/1992 Wcislo et al.
5,111,095 A 5/1992 Hendershot
5,124,607 A 6/1992 Rieber et al.
5,136,459 A 8/1992 Fararooy
5,140,290 A 8/1992 Dersch
5,153,460 A 10/1992 Bovino et al.
5,168,662 A 12/1992 Nakamura et al.
5,171,941 A 12/1992 Shimizu et al.
5,182,537 A * 1/1993 Thuis ..... 336/180
5,187,428 A * 2/1993 Hutchison et al. ..... 323/250
5,231,249 A 7/1993 Kimura et al.
5,235,488 A 8/1993 Koch
5,246,783 A * 9/1993 Spenadel et al. ..... 428/461
5,264,778 A 11/1993 Kimmel et al.
5,287,262 A 2/1994 Klein
5,304,883 A 4/1994 Denk
5,305,961 A 4/1994 Errard et al.
5,321,308 A 6/1994 Johncock
5,323,330 A 6/1994 Asplund et al.
5,325,008 A 6/1994 Grant
5,325,259 A 6/1994 Paulsson
5,327,637 A 7/1994 Breitenbach et al.
5,341,281 A 8/1994 Skibinski
5,343,139 A 8/1994 Gyugyi et al.
5,355,046 A 10/1994 Weigelt
5,365,132 A 11/1994 Hann et al.
5,387,890 A 2/1995 Estop et al.

| | | | |
|---|---|---|---|
| 5,397,513 | A | 3/1995 | Steketee, Jr. |
| 5,399,941 | A | 3/1995 | Grothaus et al. |
| 5,400,005 | A | 3/1995 | Bobry |
| 5,408,169 | A | 4/1995 | Jeanneret |
| 5,449,861 | A | 9/1995 | Fujino et al. |
| 5,452,170 | A | 9/1995 | Ohde et al. |
| 5,468,916 | A | 11/1995 | Litenas et al. |
| 5,499,178 | A | 3/1996 | Mohan |
| 5,500,632 | A | 3/1996 | Halser, III |
| 5,510,942 | A | 4/1996 | Bock et al. |
| 5,530,307 | A | 6/1996 | Horst |
| 5,533,658 | A | 7/1996 | Benedict et al. |
| 5,534,754 | A | 7/1996 | Poumey |
| 5,545,853 | A | 8/1996 | Hildreth |
| 5,550,410 | A | 8/1996 | Titus |
| 5,583,387 | A | 12/1996 | Takeuchi et al. |
| 5,587,126 | A | 12/1996 | Steketee, Jr. |
| 5,598,137 | A | 1/1997 | Alber et al. |
| 5,607,320 | A | 3/1997 | Wright |
| 5,612,510 | A | 3/1997 | Hildreth |
| 5,663,605 | A | 9/1997 | Evans et al. |
| 5,672,926 | A | 9/1997 | Brandes et al. |
| 5,689,223 | A | 11/1997 | Demarmels et al. |
| 5,807,447 | A | 9/1998 | Forrest |
| 5,834,699 | A | 11/1998 | Buck et al. |

FOREIGN PATENT DOCUMENTS

| | | | |
|---|---|---|---|
| CH | 646403 | | 2/1979 |
| CH | 657482 | | 8/1986 |
| CH | 1189322 | | 10/1986 |
| DE | 40414 | | 8/1887 |
| DE | 277012 | | 7/1914 |
| DE | 336418 | | 6/1920 |
| DE | 372390 | | 3/1923 |
| DE | 386561 | | 12/1923 |
| DE | 387973 | | 1/1924 |
| DE | 406371 | | 11/1924 |
| DE | 425551 | | 2/1926 |
| DE | 426793 | | 3/1926 |
| DE | 432169 | | 7/1926 |
| DE | 433749 | | 9/1926 |
| DE | 435608 | | 10/1926 |
| DE | 435609 | | 10/1926 |
| DE | 441717 | | 3/1927 |
| DE | 443011 | | 4/1927 |
| DE | 460124 | | 5/1928 |
| DE | 482506 | | 9/1929 |
| DE | 501181 | | 7/1930 |
| DE | 523047 | | 4/1931 |
| DE | 568508 | | 1/1933 |
| DE | 572030 | | 3/1933 |
| DE | 584639 | | 9/1933 |
| DE | 586121 | | 10/1933 |
| DE | 604972 | | 11/1934 |
| DE | 629301 | | 4/1936 |
| DE | 673545 | | 3/1939 |
| DE | 719009 | | 3/1942 |
| DE | 846583 | | 8/1952 |
| DE | 875227 | | 4/1953 |
| DE | 975999 | | 1/1963 |
| DE | 1465719 | | 5/1969 |
| DE | 1807391 | | 5/1970 |
| DE | 2050674 | | 5/1971 |
| DE | 1638176 | | 6/1971 |
| DE | 2155371 | | 5/1973 |
| DE | 2400698 | | 7/1975 |
| DE | 2520511 | | 11/1976 |
| DE | 2656389 | | 6/1978 |
| DE | 2721905 | | 11/1978 |
| DE | 137164 | | 8/1979 |
| DE | 138840 | | 11/1979 |
| DE | 2824951 | | 12/1979 |
| DE | 2839517 | | 3/1980 |
| DE | 2854520 | | 6/1980 |
| DE | 3009102 | | 9/1980 |
| DE | 2913697 | | 10/1980 |
| DE | 2920478 | | 12/1980 |
| DE | 63028777 | | 3/1981 |
| DE | 2939004 | | 4/1981 |
| DE | 3006382 | | 8/1981 |
| DE | 3008818 | | 9/1981 |
| DE | 2835386 | | 2/1982 |
| DE | 209313 | | 4/1984 |
| DE | 3305225 | | 8/1984 |
| DE | 3309051 | | 9/1984 |
| DE | 3441311 | | 5/1986 |
| DE | 3543106 | | 6/1987 |
| DE | 2917717 | | 8/1987 |
| DE | 3612112 | | 10/1987 |
| DE | 3726346 | | 2/1989 |
| DE | 3925337 | | 2/1991 |
| DE | 4023903 | | 11/1991 |
| DE | 4022476 | | 1/1992 |
| DE | 4233558 | | 3/1994 |
| DE | 4402184 | | 8/1995 |
| DE | 4409794 | | 8/1995 |
| DE | 4412761 | | 10/1995 |
| DE | 4420322 | | 12/1995 |
| DE | 19620906 | | 1/1996 |
| DE | 4438186 | | 5/1996 |
| DE | 19020222 | | 3/1997 |
| DE | 19547229 | | 6/1997 |
| DE | 468827 | | 7/1997 |
| DE | 134022 | | 12/2001 |
| EP | 049104 | | 4/1982 |
| EP | 0493704 | | 4/1982 |
| EP | 078908 | | 5/1983 |
| EP | 0120154 | | 10/1984 |
| EP | 0130124 | | 1/1985 |
| EP | 0142813 | | 5/1985 |
| EP | 0155405 | | 9/1985 |
| EP | 0102513 | | 1/1986 |
| EP | 0174783 | | 3/1986 |
| EP | 0185788 | | 7/1986 |
| EP | 0234521 | | 9/1987 |
| EP | 0244069 | | 11/1987 |
| EP | 0246377 | | 11/1987 |
| EP | 0265868 | | 5/1988 |
| EP | 0274691 | | 7/1988 |
| EP | 0280759 | | 9/1988 |
| EP | 0282876 | | 9/1988 |
| EP | 0309096 | | 3/1989 |
| EP | 0314860 | | 5/1989 |
| EP | 0316911 | | 5/1989 |
| EP | 0317248 | | 5/1989 |
| EP | 0335430 | | 10/1989 |
| EP | 0342554 | | 11/1989 |
| EP | 0221404 | | 5/1990 |
| EP | 0375101 | | 6/1990 |
| EP | 0406437 | | 1/1991 |
| EP | 0439410 | | 7/1991 |
| EP | 0440865 | | 8/1991 |
| EP | 0469155 | A1 | 2/1992 |
| EP | 0490705 | | 6/1992 |
| EP | 0503817 | | 9/1992 |
| EP | 0571155 | | 11/1993 |
| EP | 0620570 | | 10/1994 |
| EP | 0620630 | | 10/1994 |
| EP | 0642027 | | 3/1995 |
| EP | 0671632 | | 9/1995 |
| EP | 0676777 | | 10/1995 |
| EP | 0677915 | | 10/1995 |

| | | | |
|---|---|---|---|
| EP | 0684679 | | 11/1995 |
| EP | 0684682 | | 11/1995 |
| EP | 0695019 | | 1/1996 |
| EP | 0732787 | | 9/1996 |
| EP | 0739087 | A2 | 10/1996 |
| EP | 0740315 | | 10/1996 |
| EP | 07380347 | | 10/1996 |
| EP | 0749190 | A2 | 12/1996 |
| EP | 0751605 | | 1/1997 |
| EP | 0739087 | A3 | 3/1997 |
| EP | 0749193 | A3 | 3/1997 |
| EP | 0780926 | | 6/1997 |
| EP | 0802542 | | 10/1997 |
| EP | 0277358 | | 8/1998 |
| EP | 0913912 | A1 | 5/1999 |
| FR | 805544 | | 4/1936 |
| FR | 841351 | | 1/1938 |
| FR | 847899 | | 12/1938 |
| FR | 916959 | | 12/1946 |
| FR | 1011924 | | 4/1949 |
| FR | 1126975 | | 3/1955 |
| FR | 1238795 | | 7/1959 |
| FR | 2108171 | | 5/1972 |
| FR | 2251938 | | 6/1975 |
| FR | 2305879 | | 10/1976 |
| FR | 2376542 | | 7/1978 |
| FR | 2467502 | | 4/1981 |
| FR | 2481531 | | 10/1981 |
| FR | 2556146 | | 6/1985 |
| FR | 2594271 | | 8/1987 |
| FR | 2708157 | | 1/1995 |
| GB | 123906 | | 3/1919 |
| GB | 268271 | | 3/1927 |
| GB | 293861 | | 11/1928 |
| GB | 292999 | | 4/1929 |
| GB | 319313 | | 7/1929 |
| GB | 518993 | | 3/1940 |
| GB | 537609 | | 6/1941 |
| GB | 540456 | | 10/1941 |
| GB | 589071 | | 6/1947 |
| GB | 666883 | | 2/1952 |
| GB | 685416 | | 1/1953 |
| GB | 702892 | | 1/1954 |
| GB | 715226 | | 9/1954 |
| GB | 723457 | | 2/1955 |
| GB | 739962 | | 11/1955 |
| GB | 763761 | | 12/1956 |
| GB | 805721 | | 12/1958 |
| GB | 827600 | | 2/1960 |
| GB | 854728 | | 11/1960 |
| GB | 870583 | | 6/1961 |
| GB | 913386 | | 12/1962 |
| GB | 965741 | | 8/1964 |
| GB | 992249 | | 5/1965 |
| GB | 1024583 | | 3/1966 |
| GB | 1053337 | | 12/1966 |
| GB | 1059123 | | 2/1967 |
| GB | 1103098 | | 2/1968 |
| GB | 1103099 | | 2/1968 |
| GB | 1117401 | | 6/1968 |
| GB | 1135242 | | 12/1968 |
| GB | 1147049 | | 4/1969 |
| GB | 1157885 | | 7/1969 |
| GB | 1174659 | | 12/1969 |
| GB | 12360872 | | 6/1971 |
| GB | 1268770 | | 3/1972 |
| GB | 1340983 | | 12/1973 |
| GB | 1341050 | | 12/1973 |
| GB | 1365191 | | 8/1974 |
| GB | 1395152 | | 5/1975 |
| GB | 1424982 | | 2/1976 |
| GB | 1426594 | | 3/1976 |
| GB | 1438610 | | 6/1976 |
| GB | 1445284 | | 8/1976 |
| GB | 1479904 | | 7/1977 |
| GB | 1493163 | | 11/1977 |
| GB | 1502938 | | 3/1978 |
| GB | 1525745 | | 9/1978 |
| GB | 2000625 | | 1/1979 |
| GB | 1548633 | | 7/1979 |
| GB | 2046142 | | 11/1979 |
| GB | 2022327 | | 12/1979 |
| GB | 2025150 | | 1/1980 |
| GB | 2034101 | | 5/1980 |
| GB | 1574796 | | 9/1980 |
| GB | 2070470 | | 9/1981 |
| GB | 2071433 | | 9/1981 |
| GB | 2081523 | | 2/1982 |
| GB | 2099635 | | 12/1982 |
| GB | 2105925 | | 3/1983 |
| GB | 2106306 | | 4/1983 |
| GB | 2106721 | | 4/1983 |
| GB | 2136214 | | 9/1984 |
| GB | 2140195 | | 11/1984 |
| GB | 2150153 | | 6/1985 |
| GB | 2268337 | | 1/1994 |
| GB | 2273819 | | 6/1994 |
| GB | 2283133 | | 4/1995 |
| GB | 2289992 | | 12/1995 |
| GB | 2308490 | | 6/1997 |
| GB | 2332557 | | 6/1999 |
| HU | 175494 | | 11/1981 |
| JP | 60206121 | | 3/1959 |
| JP | 57043529 | | 8/1980 |
| JP | 57126117 | | 5/1982 |
| JP | 59076156 | | 10/1982 |
| JP | 59159642 | | 2/1983 |
| JP | 6264964 | | 9/1985 |
| JP | 1129737 | | 5/1989 |
| JP | 62320631 | | 6/1989 |
| JP | 2017474 | | 1/1990 |
| JP | 3245748 | | 2/1990 |
| JP | 4179107 | | 11/1990 |
| JP | 3187253 | | 1/1991 |
| JP | 424909 | | 1/1992 |
| JP | 5290947 | | 4/1992 |
| JP | 6196343 | | 12/1992 |
| JP | 6233442 | | 2/1993 |
| JP | 6325629 | | 5/1993 |
| JP | 7057951 | | 8/1993 |
| JP | 7264789 | | 3/1994 |
| JP | 8167332 | | 12/1994 |
| JP | 7161270 | | 6/1995 |
| JP | 8264039 | | 11/1995 |
| JP | 9200989 | | 1/1996 |
| JP | 8036952 | | 2/1996 |
| JP | 8167360 | | 6/1996 |
| LU | 67199 | | 3/1972 |
| SE | 90308 | | 9/1937 |
| SE | 305899 | | 11/1968 |
| SE | 255156 | | 2/1969 |
| SE | 341428 | | 12/1971 |
| SE | 453236 | | 1/1982 |
| SE | 457792 | | 6/1987 |
| SE | 502417 | | 12/1993 |
| SO | 266037 | * | 7/1985 |
| SU | 792302 | | 1/1971 |
| SU | 425268 | | 9/1974 |
| SU | 1019553 | | 1/1980 |
| SU | 694939 | | 1/1982 |
| SU | 955369 | | 8/1983 |
| SU | 1511810 | | 5/1987 |

| | | |
|---|---|---|
| WO | WO 8202617 | 8/1982 |
| WO | WO8502302 | 5/1985 |
| WO | WO9011389 | 10/1990 |
| WO | WO9012409 | 10/1990 |
| WO | PCT/DE 90/00279 | 11/1990 |
| WO | WO9101059 | 1/1991 |
| WO | Wo9101585 | 2/1991 |
| WO | WO9107807 | 3/1991 |
| WO | PCT 91/00077 | 4/1991 |
| WO | WO9109442 | 6/1991 |
| WO | WO 91/11841 | 8/1991 |
| WO | WO8115862 | 10/1991 |
| WO | WO 91/15755 | 10/1991 |
| WO | WO9201328 | 1/1992 |
| WO | WO9203870 | 3/1992 |
| WO | WO9321681 | 10/1993 |
| WO | WO9406194 | 3/1994 |
| WO | WO 97/29494 | 8/1994 |
| WO | WO9518058 | 7/1995 |
| WO | WO9522153 | 8/1995 |
| WO | WO924049 | 9/1995 |
| WO | WO 9917426 | 4/1996 |
| WO | WO9622606 | 7/1996 |
| WO | WO9622607 | 7/1996 |
| WO | PCT/CN 96/00010 | 10/1996 |
| WO | WO9630144 | 10/1996 |
| WO | WO9710640 | 3/1997 |
| WO | WO9711831 | 4/1997 |
| WO | WO9716881 | 5/1997 |
| WO | WO9745288 | 12/1997 |
| WO | WO9745847 | 12/1997 |
| WO | PCT/FR 98/0048 | 6/1998 |
| WO | WO9834315 | 6/1998 |
| WO | WO9834244 | 8/1998 |
| WO | WO9834245 | 8/1998 |
| WO | WO9834246 | 8/1998 |
| WO | WO9834247 | 8/1998 |
| WO | WO9834248 | 8/1998 |
| WO | WO9834249 | 8/1998 |
| WO | WO9834250 | 8/1998 |
| WO | WO9834309 | 8/1998 |
| WO | WO9834312 | 8/1998 |
| WO | WO9834321 | 8/1998 |
| WO | WO9834322 | 8/1998 |
| WO | WO9834323 | 8/1998 |
| WO | WO9834325 | 8/1998 |
| WO | WO9834326 | 8/1998 |
| WO | WO9834327 | 8/1998 |
| WO | WO9834328 | 8/1998 |
| WO | WO9834329 | 8/1998 |
| WO | WO9834330 | 8/1998 |
| WO | WO 9834331 | 8/1998 |
| WO | WO 98/40627 | 9/1998 |
| WO | WO 98/43336 | 10/1998 |
| WO | WO 9917309 | 4/1999 |
| WO | WO 9917311 | 4/1999 |
| WO | WO 9917312 | 4/1999 |
| WO | WO 9917313 | 4/1999 |
| WO | WO 9917314 | 4/1999 |
| WO | WO 9917315 | 4/1999 |
| WO | WO 9917316 | 4/1999 |
| WO | WO 9917422 | 4/1999 |
| WO | WO 9917424 | 4/1999 |
| WO | WO 9917425 | 4/1999 |
| WO | WO 9917427 | 4/1999 |
| WO | WO 9917428 | 4/1999 |
| WO | WO9917429 | 4/1999 |
| WO | WO9917432 | 4/1999 |
| WO | WO9917433 | 4/1999 |
| WO | WO9919963 | 4/1999 |
| WO | WO9919969 | 4/1999 |
| WO | WO9919970 | 4/1999 |
| WO | PCT/SE 98/02148 | 6/1999 |
| WO | WO9927546 | 6/1999 |
| WO | WO9928919 | 6/1999 |
| WO | WO9928921 | 6/1999 |
| WO | WO9928923 | 6/1999 |
| WO | WO9928924 | 6/1999 |
| WO | WO9928925 | 6/1999 |
| WO | WO9928926 | 6/1999 |
| WO | WO9928927 | 6/1999 |
| WO | WO9928928 | 6/1999 |
| WO | WO9928929 | 6/1999 |
| WO | WO9928930 | 6/1999 |
| WO | WO9928931 | 6/1999 |
| WO | WO9928934 | 6/1999 |
| WO | WO9928994 | 6/1999 |
| WO | WO9929005 | 6/1999 |
| WO | WO9929008 | 6/1999 |
| WO | WO9929011 | 6/1999 |
| WO | WO9929012 | 6/1999 |
| WO | WO9929013 | 6/1999 |
| WO | WO9929014 | 6/1999 |
| WO | WO9929015 | 6/1999 |
| WO | WO9929016 | 6/1999 |
| WO | WO9929017 | 6/1999 |
| WO | WO9929018 | 6/1999 |
| WO | WO9929019 | 6/1999 |
| WO | WO9929020 | 6/1999 |
| WO | WO9929021 | 6/1999 |
| WO | WO9929022 | 6/1999 |
| WO | WO9929024 | 6/1999 |
| WO | WO9929026 | 6/1999 |
| WO | WO9929029 | 6/1999 |
| WO | WO9929034 | 6/1999 |

OTHER PUBLICATIONS

P. Kundur, "Power System Stability and Control," *Electric Power Research Institute Power System Engineering Series*, McGraw–Hill, Inc.*

R. F. Schiferl and C. M. Ong, "Six Phase Synchronous Machine with AC and DC Stator Connections, Part II: Harmonic Studies and a Proposed Uninterruptible Power Suply Scheme", *IEEE Transactions on Power Apparatus and Systems*, vol. PAS–102, No. 8, Aug. 1983, pp. 2694–2701.*

R. F. Schiferl and C. M. Ong, "Six Phase Synchronous Machine with AC and DC Stator Connections, Part I: Equivalent Circuit Representation and Steady–State Analysisi, *IEEE Transactions on Power Apparatus and Systems*," vol. PAS–102, No. 8, Aug. 1983, pp. 2685–2693.*

T. Petersson, *Reactive Power Compensation*, Abb Power Systems AB, Dec. 1993.*

"Different types of Permanent Magnet Rotors", a summary by ABB Corporate Research, Nov. 1997.*

K. Binns, Permanent Magnet Machines, *Handbook of Electric Machines*, Chapter 9, McGraw–Hill, 1987, pp. 9–1—9–12.*

A test installation of a self–tuned ac filter in the Konti–Skan 2 HVDC link; T. Holmgren, G. Asplund, S. Valdemarsson, P. HIdman of ABB; U. Jonsson of Svenska Kraftnat; O. loof of Vattenfall Vastsverige AB; IEEE Stockholm Power Tech Conference Jun. 1995, pp 64–70.

Analysis of faulted Power Systems; P Anderson, Iowa State University Press I Ames, Iowa, 1973, pp 255–257.

36–Kv. Generators Arise from Insulation Research; P. Sidler, *Electrical World* Oct. 15, 1932, ppp. 524.

Oil Water cooled 300 MW turbine generator;L.P. Gnedin et al;*Electrotechnika*, 1970, pp. 6–8.
J&P Transformer Book 11$^{th}$ Edition;A.C. Franklin et al; oned by Butterworth—Heinemann Ltd, Oxford Printed by Hartnolls Ltd in Great Britain 1983, pp 29–67.
Transformerboard; H.P. Moser et al; 1979, pp. 1–19.
The Skagerrak transmission—the world's longest HVDC submarine cable link; L. Haglof et al of ASEA; ASEA Journal vol 53, No. 1–2, 1980, pp. 3–12.
Direct Connection of Generators to HVDC Converters: Main Characteristics and Comparitive Advantages; J.Arrillaga et al; *Electra* No. 149, 08/ 1993, pp. 19–37.
Our flexible friend aritcle; M. Judge; *New Scientist*, May 10, 1997, pp. 44–48.
In–Service Performance of HVDC Converter transformers and oil–cooled smoothing reactors; G.L. Desilets et al; *Electra* No. 155, 08/1994, pp. 7–29.
Transformateurs a courant continu haute tension–examen des specifications; A. Lindroth et al; *Electra* No. 141, 04/1992, pp 34–39.
Development of a Termination for the 77 kV–Class High Tc Superconducting Power Cable; T. Shimonosono et al; IEEE Power Delivery, vol. 12, No. 1, 01/1997, pp. 33–38.
Verification of Limiter Performance in Modern Excitation Control Systems; G. K. Girgis et al; IEEE Energy Conservation, vol. 10, No. 3, Sep. 1995, pp. 538–542.
A High Initial response Brushless Exitation System; T. L. Dillman et al; IEEE Power Generation Winter Meeting Proceedings, Jan. 31, 1971, pp. 2089–2094.
Design, manufacturing and cold test of a superconducting coil and its cryostat for SMES applications; A. Bautista et al; IEEE Applied Superconductivity, vol. 7, No. 2, Jun. 1997, pp. 853–856.
Quench Protection and Stagnant Normal Zones in a Large Cryostable SMES; Y. Lvovsky et al; IEEE Applied Superconductivity, vol. 7, No. 2, Jun. 1997, pp. 857–860.
Design and Construction of the 3 Tesla Background Coil for the Navy SMES Cable Test Apparatus; D.W. Scherbarth et al; IEEE Appliel Superconductivity, vol. 7, No. 2, Jun. 1997, pp. 840–843.
High Speed Synchronous Motors Adjustable Speed Drivers; ASEA Generation Pamphlet OG 135–101 E, Jan. 1985, pp. 1–4.
Billig burk motar overtonen; A. Felldin; *ERA* (TEKNIK) Aug. 1994, pp. 26–28.
400–kV XLPE cable sytem passes CIGRE test; ABB Article; ABB Review Sep. 1995, pp. 38.
Freqsyn—a new drive system for high power applications;J–A. Bergman et al; ASEA Journal 59, Apr. 1986, pp. 16–19.
Canadians Create Conductive Concrete; J. Beaudoin et al; *Science*, vol. 276, May 23, 1997, pp. 1201.
Fully Water–Cooled 190 MVA Generators in the Tonstad Hydroelectric Power Station; E. Ostby et al; BBC Review Aug. 1969, pp. 380–385.
Relocatable static var compensators help control unbundled power flows; R.C. Knight et al; *Transmission & Distribution*, Dec. 1996, pp. 49–54.
Investigation and Use of Asynchronized Machiens in Power Systems*; N.I.Blotskii et al; *Elektrichestvo*, No. 12, 1–6, 1985, pp. 90–99.
Variable–speed switched reluctance motors; P.J. Lawrenson et al; IEE prc, vol. 127, PtB, No. 4, Jul. 1980, pp. 253–265.
Das Einphasenwechselstromsytem hoherer Frequenz; J.G. Heft; Elektrische Bahnen eb; Dec. 1987, pp. 388–389.
Power Transmission by Direct Current;E. Uhlmann;ISBN 3–540–07122–9 Springer–Verlag, Berlin/Heidelberg/New York; 1975, pp. 327–328.
Elektriska Maskiner; F. Gustavson; Institute for Elkreafteknilk, KTH; Stockholm, 1996, pp. 3–6—3–12.
Die Wechselstromtechnik; A. Cour'Springer Verlag, Germany; 1936, pp. 586–598.
Insulation systems for superconducting transmission cables; O. Toennesen; Nordic Insulation Symosium, Bergen, 1996, pp 425–432.
MPTC: An economical alternative to universal power flow controllers;N. Mohan; EPE 1997, Trondheim, pp. 3.1027–3.1030.
Lexikon der Technik; Luger; Band 2, Grundlagen der Elektrotecknik und Kerntechnik, 1960, pp. 395.
Das Handbuch der Lokomotiven (hungarian Iocomotive V40 1'D'); B. Hollingsworth et al; Pawlak Verlagsgesellschaft; 1933, pp. 254–255.
Synchronous machines with single or double 3–phase star–connected winding fed by 12–pulse load commutated inverter. Simulation of operational behaviour; C. Ivarson et al; ICEM 1994, International Conference on electrical mahcines, vol. 1, pp. 267–272.
Elkrafthandboken, Elmaskiner; A. Rejminger; Elkrafthandboken, Elmaskiner 1996, 15–20.
Power Electronics—in Theory and Practice; K. Thorborg; ISBN 0–86238–341–2, 1993, pp. 1–13.
Regulating transformers in power systems– new concepts and applications; E. Wirth et al; ABB Review Apr. 1997, pp. 12–20.
Transforming transformers; S. Mehta et al; *IEEE Spectrum*, Jul. 1997, pp. 43–49.
A study of equipment sizes and constraints for a unified power flow controller; J. Bian et al; IEEE Transactions on Poer Delivery, vol. 12, No. 3, Jul. 1997, pp. 1385–1391.
Industrial High Voltage; F.H. Kreuger; *Industrial High Voltage* 1991 vol. 1, pp. 113–117.
Hochspannungstechnik; A. Küchler; Hochspannungstechnik, VDI Verlag 1996, pp. 365–366, ISBN 3–18–401530–0 or 3–540–62070–2.
High Voltage Enginering; N.S. Naidu; High Voltage Engineering ,Second edition 1995 ISBN 0–07–462286–2, Chapter 5, pp. 91–98.
Performance Characteristics of a Wide Range Induction Type Frequency Converter; G.A. Ghoneem; Ieema Journal, Sep. 1995, pp. 21–34.
International Electrotechnical Vocabulary, Chapter 551 Power ELectronics;unknown author; International Electrotechnical Vocabulary Chapter 551: Power Electronics Bureau Central de la Commission Electrotechnique Internationale, Geneve; 1982, pp. 1–65.
Design and manufacture of a large superconducting homopolar motor; A.D. Appleton; IEEE Transactions on Magnetics, vol. 19, No. 3, Part. 2, May 1983, pp. 1048–1050.
Application of high temperature superconductivy to electric motor design; J.S. Edmonds et al; IEEE Transactions on Energy Conversion Jun. 1992, No. 2, pp. 322–329.
Power Electronics and Variable Frequency Drives; B. Bimal; IEEE industrial Electronics—Technology and Applications, 1996, pp. 356.

Properties of High Plymer Cement Mortar; M. Tamai et al; *Science & Technology in Japan, No. 63*; 1977, pp. 6–14.
Weatherability of Polymer–Modified Mortars after Ten–Year Outdoor Exposure in Koriyama and Sapporo; Y. Ohama et al; *Science & Technology in Japan No. 63*; 1977, pp. 26–31.
SMC Powders Open New Magnetic Applications; M. Persson (Editor); *SMC Update*, vol. 1, No. 1, Apr. 1997.
Characteristics of a laser triggered spark gap using air, Ar, CH4,H2, He, N2, SF6 and Xe; W.D. Kimura et al; Journal of Applied Physics, vol. 63, No. 6, Mar. 15, 1988, pp. 1882–1888.
Low–intensity laser–triggering of rail–gasps with magnesium–aerosol switching–gases; W. Frey; 11th International Pulse Power Conference, 1997, Baltimore, USA Digest of Technical Papers, pp. 322–327.
SHipboard Electrical Insulation; G. L. Moses, 1951, pp.2&3.
ABB Elkrathandbok; ABB AB; ; pp.274–276.
Elkraft teknisk Handbok, 2 ELmaskiner; A. Alfredsson et al; 1988, pp. 121–123.
High Voltage Cables in a New Class of Generators powerformer; M. Leijon et al; Jun. 14, 1999; pp. 1–8.
Ohne Tranformator direkt ins Netz; Owman et al, ABB, AB; Feb. 8, 1999; pp. 48–51.
Submersible Motors and Wet–Rotor for Centrifugal Pumps Submerged in the Fluid Handled; K.. Bienick, KSB; pp. 9–17.
High Voltage Generators; G. Beschastnov et al; 1977; vol. 48, No. 6 pp. 1–7.
Eine neue Type von Unterwassermotoren; ELectrotechnik und Maschinenbam, 49; Aug. 1931; pp. 2–3.
Problems in design of the 110–5OokV high–voltage generators; Nikiti et al; World Electrotechnical Congress; 6/24–27/77; Section 1. Paper #18.
Manufacture and Testing of Roebel bars; P. Marti et al; 1960, Pub. 86, vol. 8, pp. 25–31.
Hydroalternators of 110 and 220 kV Elektrotechn. Obz., vol. 64, No. 3, pp. 132–136 Mar. 1975; A. Abramov.
Design Concepts for an Amorphous Metal Distribution Transformer; E. Boyd et al; IEEE 11/84.
Neue Wege zum Bau zweipoliger Turbogeneratoren bis 2 GVA, 6OkV Elektrotechnik und Maschinenbau Wien Janner 1972, Heft 2, Seite 1–11; G. Aichholzer.
Optimizing designs of water–resistant magnet wire; V. Kuzxenev et al; Elektrotekhnika, vol. 59, No. 12, pp. 35–40, 1988.
Zur Entwicklung der Tauchumpenmotoren; A. Schanz; KSB, pp.19–24.
Direct Generation of alternating at high voltagers; R. Parsons; 4/29 IEEE Journal, vol. 67 #393, pp. 1065–1080.
Stopfbachslose Umwaizpumpen– ein wichtiges Element im modernen Kraftwerkbau; H. Hoiz, KSB 1, pp. 13–19, 1960.
Zur Geschichte der Brown Boveri–Synchron–Masonien; Vierzig Jahre Generatorbau; Jan.–Feb. 1931 pp. 15–39.
Technik und Anwendung moderner Tauchpumpen; A. Heumann.
High capacity synchronous generator having no tooth stator; V.S. Kildishev et al; No. 1, 1977 pp. 11–16.
Der Asynchronmotor als Antrieb stopfbcichsloser Pumpen; E. Picmaus; Electrotechnik und Mashineenbay No. 78, pp. 153–155, 1961.
Low core loss rotating flux transformer; R. F. Krause, et al; American Institute Physics J.Appl.Phys vol. 64 #10 Nov. 1988, pp. 5376–5378.
An EHV bulk Power transmission line Made with Low Loss XLPE Cable; Ichihara et al.
Undergroud Transmission Systems Reference Book.
Powder System Stability and Control; P. Kundur.
Six phase Synchronous Machine with AC and DC Stator Connections, Part II: Harmonic Studies and a proposed uninterruptible Power Supply Scheme; R. Schiferl et al.
Six phase Synchronous Machine with AC and DC Stator Connections, Part 1: Equivalent circuit representation and Steady–State Analysis; R. Schiferl et al.
Reactive Power Compensation; T. Peterson.
Different Types of Permanent Magnet Rotors.
Permanent Magnet Machines; K. Binns.
Hochspannungsaniagen for Wechselstrom; 97. Hochspannungsaufgaben an Generatoren und Motoren; Roth et al; pp. 452–455.
Hochspannungsanlagen for Wechselstrom; 97. Hochspannungsaufgaben an Generatoren und Motoren; Roth et al; Spring 1959, pp. 30–33.
Neue Lbsungswege zum Entwurf grosser Turbogeneratoren bis 2 GVA, 60kV; G. Aicholzer, Sep. 1974, pp. 249–255.
Advanced Turbine–generators– an assessment; A. Appleton, et al; International Conf. Proceedigns, Lg HV Elec. Sys. Paris, FR, Aug.–Sep./1976, vol. I, Section 11/02, pg. 1–9.
Fully slotless turbogenerators;. E. Spooner, Proc., IEEE vol 120 #12, Dec. 1973.
Toroidal winding geometry for high voltage superconducting alternators; J. Kirtley et al; MIT—Elec. Power Sys. Engrg. Lab for IEEE PES 2/74.
High–Voltage Stator Winding Development; D. Albright et al; Proj. Report EL339, Project 1716, Apr. 1984.
Powerformer™: A giant step in power plant engineering; Owman et al; CIGRE 1998, Paper 11:1.1.
Thin Type DC/DC Converter using a coreless wire transformer; K. Onda et al; Proc. IEEE Poer Electronics Spec. Conf. 6/94, pp. 330–334.
Development of extruded polymer insulated superconducting cable.
Transformer core losses; B. Richardson; Proc. IEEE May 1986, pp. 365–368.
Cloth–transfomer with divided windings and tension annealed amorphous wire; T. Yammamoto et al; IEEE Translation Journal on Magnetics in Japan vol. 4, No. 9 Sep. 1989.
A study of equipment sizes and constraints for a unified power flow controller; J Brian et al; IEEE 1996.

* cited by examiner

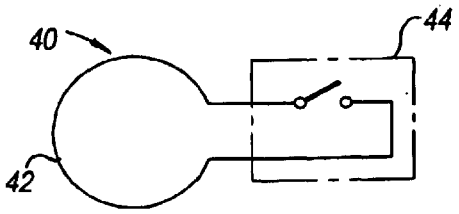
FIG. 3A
FIG. 3C
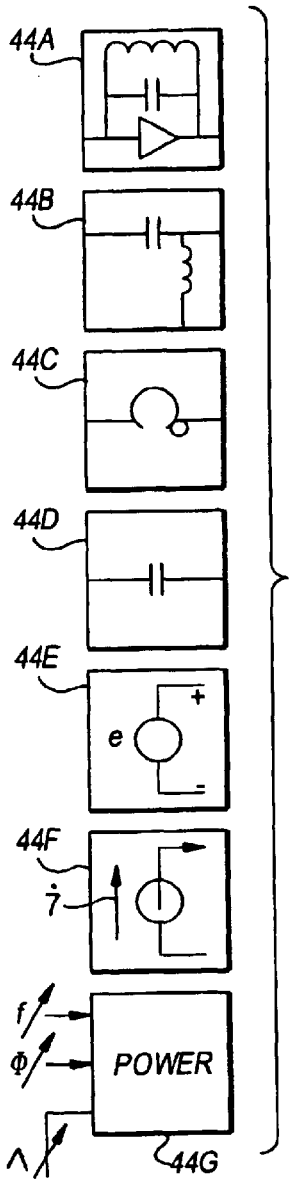
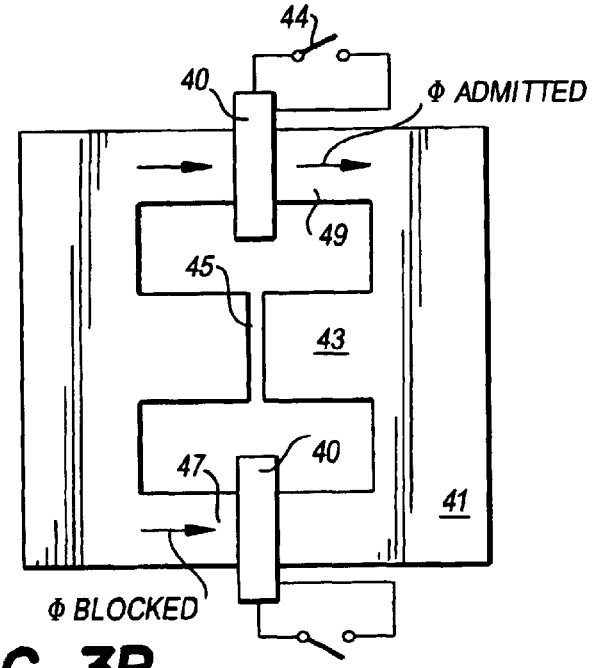
FIG. 3B
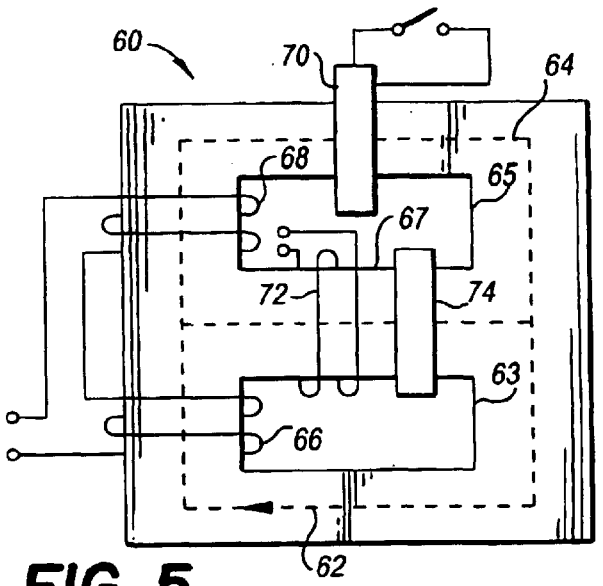
FIG. 5

40-1A
74-1
40-1B
74-N
72
Appl
40-NA
70
40-NB 40-1A
90-N
40-NB
90-2
74-1
AP
40-NA
90-N
74-N
70
40-NB

70

SWITCHABLE FLUX CONTROL FOR HIGH POWER STATIC ELECTROMAGNETIC DEVICES

BACKGROUND OF THE INVENTION

The present invention relates to a selectively controllable high power static electromagnetic device, and in particular to a controllable high power transformer, reactor, inductance, or regulator with switchable step function selectively. As used herein the high power devices include those having a rated power ranging from a few hundred kVA up to more than 1000 MVA with a rated voltage ranging from 3–4 kV and up to very high transmission voltages, 400 kV to 800 kV or higher.

In the transmission and distribution of electric energy, various known static inductive devices such as transformers, reactors, regulators and the like are used. The purpose of such devices is to allow exchange or control of electric energy in and between two or more electric systems. Such devices belong to an electrical product group known as static inductive devices. Energy transfer is achieved by electromagnetic induction. There are a great number of textbooks, patents and articles which describe the theory, operation and manufacture of such devices and associated systems, and a detailed discussion is not necessary.

Conventional electric high voltage control is generally achieved by transformers having one or more windings wound on one or more legs of the transformer core. The windings often include taps making it possible to supply different voltage levels from the transformer. Known power transformers and distribution transformers used in high voltage trunk lines involve tap-changers for the voltage regulation. These are mechanically complicated and are subject to mechanical wear and electrophysical erosion due to discharges between contacts.

SUMMARY OF THE INVENTION

The invention provides a high power static electromagnetic or induction device with a rated power ranging from a few hundred kVA up to over 1000 MVA with a rated voltage ranging from 3–4 kV and up to very high transmission voltages, such as 400 kV to 800 kV or higher, and which does not entail the disadvantages, problems and limitations which are associated with the prior art power devices.

The invention is based on the discovery that selective switchable control of the flux paths in the device enables broad control functions not hereinbefore available.

In a particular embodiment the invention comprises a high power static induction device having a flux bearing path, a main winding and a at least one regulation winding in operative relation therewith. A control in operative relationship with the flux bearing region selectively admits or blocks flux therein. The control may be in the form of a switchable conductive ring having one or more turns. At least one of the windings is formed of one or more current-carrying conductors surrounded by a magnetically permeable, electric field confining insulating cover.

In a particular exemplary embodiment, the cover comprises a solid insulation surrounded by an outer and an inner potential-equalizing layer being partially conductive or having semiconducting properties. The electric conductor is located within the inner layer. As a result the electric field is confined within the winding. The electric conductor, according to the invention, is arranged so that it has conducting contact with the inner semiconducting layer. As a result no harmful potential differences arise in the boundary layer between the innermost part of the solid insulation and the surrounding inner semiconductor along the length of the conductor.

According to an exemplary embodiment of the invention, the device has a flux bearing region and a control in operative relationship therewith for selectively admitting or blocking the flux there through for regulating the device. In a transformer having a plurality of legs or flux paths in the flux bearing region, the flux may be selectively admitted or blocked in each of said plurality of the legs so that various voltage outputs may be achieved. In a reactor, selective control of the flux in the core results in a switchable flux bearing region in the reactor. In a regulator, switchable voltage control is achieved. Depending on the type of control used, regulation may be in discrete steps corresponding to discrete or selective opening or closing of flux paths.

The invention employs windings having semiconducting layers which exhibit similar thermal properties to the solid insulation as regards the coefficient of thermal expansion. The semiconducting layers according to the invention may be integrated with the solid insulation so that these layers and the adjoining insulation exhibit similar thermal properties to ensure good contact independently of the variations in temperature which arise in the line at different loads. At temperature gradients the insulating layer and semiconducting layers form a monolithic core for the conduction and defects caused by different temperature expansion in the insulation and the surrounding layers do not arise.

The electric load on the material is reduced because the semiconducting layers form equipotential surfaces and the electric field in the insulating part is distributed nearly uniformly over the thickness of the insulation.

In particular, the outer semiconducting layer exhibits such electrical properties that potential equalization along the conductor is achieved. The semiconducting layer does not, however, exhibit such conductivity properties that the induced current causes an unwanted thermal load. Further, the conductive properties of the layer are sufficient result in that an equipotential surface. Exemplary thereof, the resistivity, $\rho$, of the semiconducting layer generally exhibits a minimum value, pmin=1 Ωcm, and a maximum value, pmax=100 kΩcm, and, in addition, the resistance of the semiconducting layer per unit of length in the axial extent, R, of the cable generally exhibits a minimum value $R_{min}$=50 Ω/m and a maximum value $R_{max}$=50 MΩ/m.

The inner semiconducting layer exhibits sufficient electrical conductivity in order for it to function in a potential-equalizing manner and hence equalizing with respect to the electric field outside the inner layer. In this connection the inner layer has such properties that any irregularities in the surface of the conductor are equalized, and the inner layer forms an equipotential surface with a high surface finish at the boundary layer with the solid insulation. The layer may, as such, be formed with a varying thickness but to ensure an even surface with respect to the conductor and the solid insulation, its thickness is generally between 0.5 and 1 mm. However, the inner layer does not exhibit such a great conductivity that it contributes to induce voltages. Exemplary thereof, for the inner semiconducting layer, thus, Pmin=$10^{-6}$ Ωcm, $R_{min}$=50 μΩ/m and, in a corresponding way, Pmax=100 kΩcm, $R_{max}$=5 MΩ/m.

In an exemplary embodiment, a transformer according to the invention operates as a series element with selectable leakage inductance and thus reactance. Such a transformer is capable of controlling power flow by redistribution of active or reactive effects between networks connected to the primary and secondary. Such a transformer is capable of limiting short circuit currents, and provides for good transient stability. The transformer is also capable of damping power oscillations and providing good voltage stability.

The present invention, allows for a flexible AC transmission system with control of the components wherein the power flow can be controlled. In the particular embodiment, the ability to control or regulate power flow is implemented in a component which is normally needed for other purposes. Thus, the invention allows for dual use without significant increase in cost.

In accordance with another embodiment of the invention, a reactor may be switchably operable either as a series or shunt element with selectable inductance and thus reactance. There is no need for power electronics in the main power circuit. Accordingly, losses are lower. Further, the control equipment is generally low voltage equipment and thus, simpler and more economical. The arrangement also avoids the problem of harmonics generation. As a shunt element, the reactor can perform fast variable reactive power compensation. As a series element, the reactor is capable of performing power flow control by redistribution of active or reactive effect between lines. The reactor can limit short circuit currents, provide transient stability, damp power oscillations and provide voltage stability. These features are likewise important for flexible AC transmission systems.

The drawbacks of prior art voltage regulation are avoided by a switchable voltage regulator according to the invention, wherein the magnetic circuit of the regulator includes at least one regulation leg having a flux bearing region switchable between open and closed states, and by at least one regulation winding wound around said regulation leg, said regulation winding being connected to the main winding. It is also possible to place at least one winding loaded with a variable capacity on at least one magnetic flux path or leg having a zone with reduced permeability across the magnetic flux, to vary the reluctance of the leg by varying the impedance.

BRIEF DESCRIPTION OF THE DRAWINGS

The invention will now be described with reference to the accompanying drawings, wherein

FIG. 3 shows an embodiment of a power transformer according to the invention;

FIG. 3A illustrates a magnetic switch in accordance with the invention;

FIG. 3B shows an open and closed flux path corresponding to open and closed magnetic switches;

FIG. 3C is a schematic illustration showing various forms of the control circuit 44;

FIG. 5 is a schematic illustration of a reactor in accordance with the present invention;

DESCRIPTION OF THE INVENTION

The inventive concept which forms the basis of the present invention is applicable to various static inductive devices including, power transformers, reactors and regulators. As is known, the devices herein categorized may be designed as single-phase and three-phase systems. Such devices include various types of known devices such as boost transformers, auto transformers and the like. Also, air-insulated and oil-insulated, self-cooled, oil cooled, etc., devices are available. Although devices have one or more windings (per phase) and may be designed both with and without an iron core, the description generally shows devices with an iron core having a selectable region of variable high reluctance.

The invention further relates more specifically to a controllable inductance wherein the magnetic flux is selectively redistributed among and between different flux paths by affecting the reluctance of at least one of such paths. In a reactor the invention operates as a series or shunt element with a selectable variable inductance.

Figure 1:
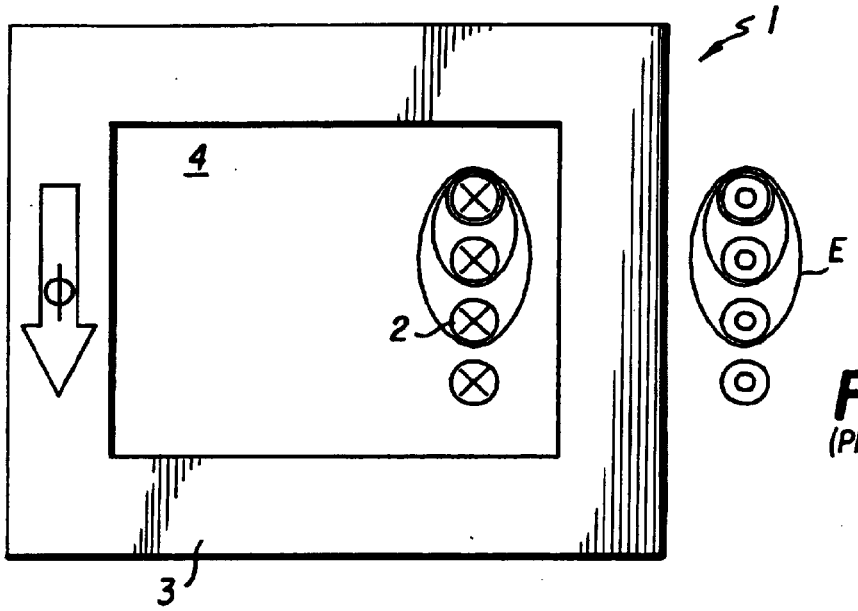
FIG. 1 (PRIOR ART)
FIG. 1 shows the electric field distribution around a winding of a conventional a inductive device such as a power transformer or reactor.

FIG. 1 shows a simplified and fundamental view of the electric field distribution around a winding of a conventional static induction device such as a power transformer/reactor 1, including a winding 2 and a core 3. Equipotential lines E show where the electric field has the same magnitude. The lower part of the winding is assumed to be at earth potential. The core 3 has a window 4.

The potential distribution determines the composition of the insulation system since it is necessary to have sufficient insulation both between adjacent turns of the winding and between each turn and earth. In FIG. 1 the upper part of the winding is subjected to the highest dielectric stress. The design and location of a winding relative to the core are in this way determined substantially by the electric field distribution in the core window 4.

Figure 2:
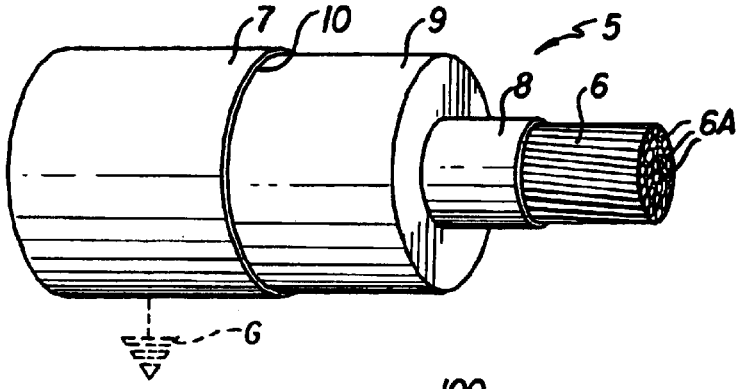
FIG. 2 shows an embodiment of a winding in the form of a cable in a high power inductive device according to the invention.

FIG. 2 shows an example of an exemplary cable 5 which may be used in windings which are included in high power inductive devices according to the invention. Such a cable 5 comprises at least one conductor 6 including a number of strands 6A with a covering 7 surrounding the conductor. The covering includes an inner semiconducting layer 8 disposed around the strands. Outside of this inner semiconducting layer is the main insulation layer 9 of the cable in the form of a solid insulation, and surrounding this solid insulation is an outer semiconducting layer 10. The cable 5 may be provided with other additional layers for special purposes, for example for preventing too high electric stresses on other regions of the device. The outer layer 10 may be connected to ground G as shown. From the point of view of geometrical dimension, the cables 5 in question will generally have a conductor area which is between about 30 and 3000 $mm^2$ and an outer cable diameter which is between about 20 and 250 mm. The covering 7 is an integrated structure which is substantially void free, that is, free of air pockets and the like.

FIG. 3 shows a high power inductive device in the form of a single phase core type transformer 11 in accordance with the present invention. The transformer 11 comprises a core 12 which is formed with main or outer legs 14,16 and short or inner legs 18 and 20, and respective lower, middle and upper arms 22, 24 and 26. The core 12 may be made of laminated iron sheets having a main or large aperture or window 28 and a plurality of small or regulation windows 30-1, 30-2 and 30-m, in a regulation region 32 located generally between the middle and upper arms 24 and 26 as shown. In the exemplary embodiment, m=3.

In order to form a core type transformer, a primary winding 34 is wrapped around the leg 14. In a similar manner, a secondary winding 36 may be wrapped concentrically with the primary winding 34 around the leg 14 or on another leg. A regulation winding 37 formed of one or more regulation sub-windings or coils 38-1 . . . , 38-n in series of the primary winding 34 may be wrapped around the respective inner legs 18 and 20 as shown.

Control means in the form of one or more conductive short circuit rings 40-1 . . . , 40-n may be located as shown. For example, rings 40-1, 40-2 and 40-3 surround the middle arm 24 and extend through the windows 28 and 30-1, 30-2 and 30-m respectively. In the similar manner rings 404, 40-5 and 40-n surround the upper arm 26 in the windows 30-1, 30-2 and 30-m respectively. It should be understood that the suffix 1, 2, 3, m and n are used to designate the position of the corresponding element, and are otherwise not used when the position is not relevant to the discussion.

In the exemplary embodiment, and as shown in FIG. 3A, ring 40 comprises one or more turns of a conductor 42, e.g. copper terminated such as switch 44. When the switch 44 is closed the corresponding ring forms a short circuit. In other embodiments, the control 44 may be an active or passive filter, a reactance or voltage or current supply. FIG. 3 schematically shows alternative arrangements for the control 44. For example, the control 44 may be in the form of an active filter 44A, a passive filter 44B, a pure reactance 44C or 44D, a voltage supply 44E or a current supply 44F. The control 44 may also include a power source 44G capable of varying the amplitude frequency and phase of the flux, for example, by superimposing a fixed or variable signal on the loop 40 so that the frequency amplitude and phase of the flux may be varied or modulated.

The windings 34, 36 and 38 produce the flux $\phi$, which is carried by the core 12 along one or more possible alternative paths as shown by the dotted lines in each of the legs 14, 16, 18, 20 and the arms 22, 24 and 26. In a device 46 shown in FIG. 3B, when any switch 44 of a corresponding ring 40 is open, the corresponding flux path through the leg or arm of the core, as the case may be, surrounded by ring is open. Likewise, when a switch 44 is closed, the flux path through the core, at that point, is blocked. The core 41 in FIG. 5 may have a central leg, 43 with an air gap 45 as shown. As is well known, the air gap 45 has a region of reduced or low permeability relative to the core 41. It should be further understood that an insert of a low permeability metal may be placed in the air gap 45. Blocking the lower legs 47, as shown, redirects the flux into the central leg 43 through the air gap 45.

In accordance with the invention, when the switch 44 is open circuit, the upper core leg 49 exhibits a given relatively low reluctance (high permeability) to the flux fee. However, when the switch 44 is closed, the leg will exhibit high reluctance (low permeability). Thus zones of high and low reluctance are produced which correspond to zones of low and high reluctance respectively.

Figure 4:
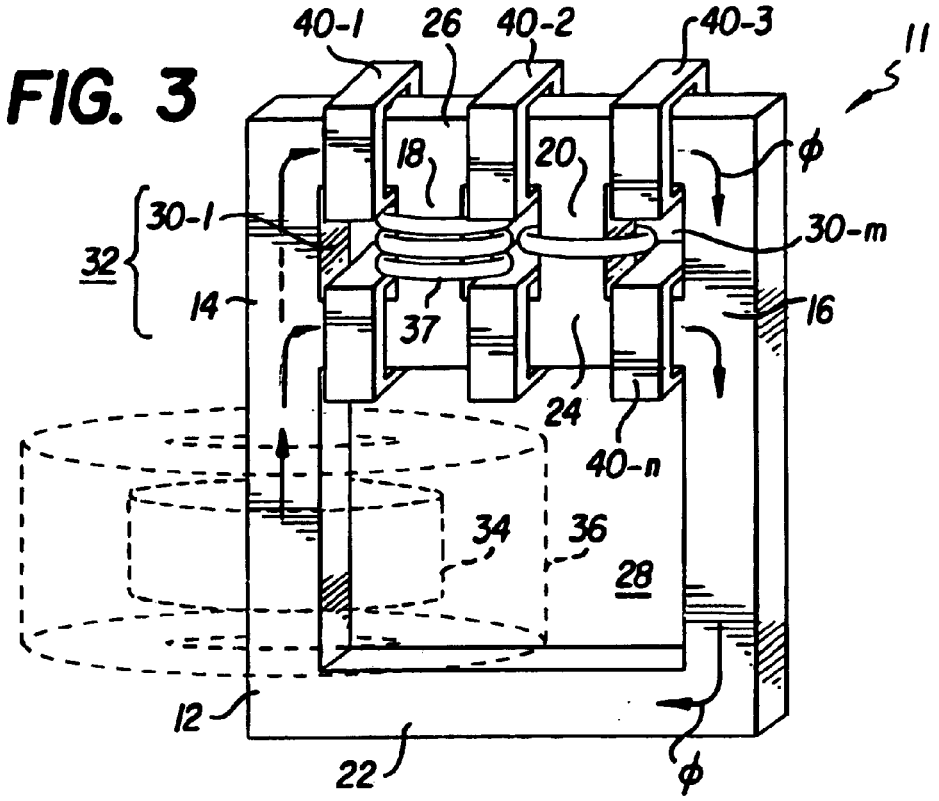
FIG. 4 is a schematic illustration of a regulation leg portion of the transformer of FIG. 3.
Figure 4:
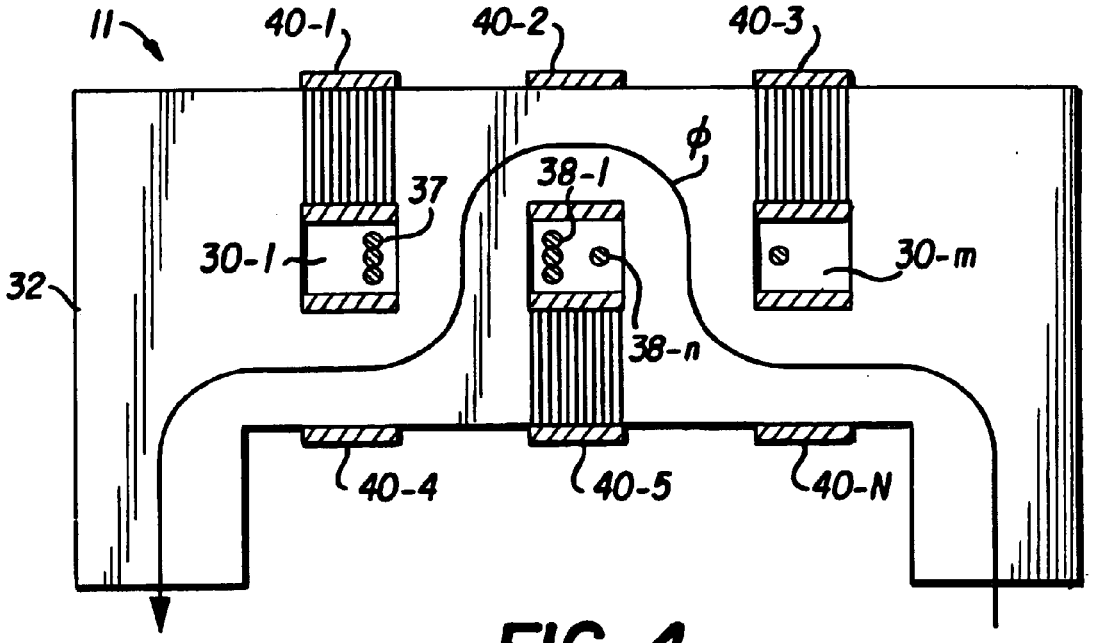

FIG. 4 is a fragmentary portion of the regulation region 32 of the transformer 11 shown in FIG. 3, illustrating in greater detail stepwise magnetic flux regulation according to the invention. In the exemplary embodiment of FIG. 3, the magnetically regulated transformer 11 has the low voltage (LV) winding 34 ($N_{LV}$ turns), the high voltage (HV) winding 36 ($N_{HV}$ turns) and the at least one additional regulation (R) winding 37 ($N_{RO}$ turns) in series with the LV winding 34. Voltage regulation is then obtained by changing the transformer ratio $N_{HV}/(N_{LV}+N_R)$, where $N_R$ is an effective number of regulation turns. $N_R$ can be varied over some subinterval of $[-N_R+N_R]$ by actively linking the main magnetic flux through different parts of the regulation windings. The linking is performed with an arrangement of switchable magnetic rings 40 in the core 12, each of which should as completely as possible exclude the flux from a selected region of the core, or admit the flux through with a minimum of reluctance. In the regulation winding 37 the separate subcoils 38-1 . . . , 38-n (n=2) are wound in series through the windows 30-1 . . . , 30-m (m=3) in the regulation or upper portion 32 of the core 12.

The principle of the invention illustrated in FIG. 4 shows that magnetic switching is achieved with the short circuit rings 40, which, when switched closed, block the passage of flux through the corresponding sub-coil 38. Likewise, when opening, the rings 40 admit the flux 4 into the core segment and direct it through or past the subcoils. Depending on the arrangement, flux control occurs in a number of ways, each representing a single noncirculating path through the regulation region 32 and a unique value of $N_R$. In the example of FIG. 4, $N_R$=1–3=–2. The regulation region 32 is dimensioned for maximum flux along any allowed path. Accordingly, the regulation region 32 is at least twice the size of a conventional core without regulation.

In accordance with another embodiment of the invention, a reactor 60 is shown in FIG. 5. The reactor 60 has a main flux path 62 shown as a dotted line surrounding a lower window 63, and a regulating flux path 64 shown as a dotted line surrounding the upper window 65. The path 62 and 64 are parallel when the central leg 67 is magnetically closed so that the flux can pass therethrough. However, the path 62 and 63 become a signal single series loop when the leg 67 is magnetically an open circuit. A main winding 66 in the main path 62 is in series with a regulating winding 68 in the regulating path 64. A magnetic contact switch 70 is in the regulating path 64 as shown. When closed, the magnetic switch 70 blocks the regulating path 64, and when open the magnetic switch 70 opens the magnetic path. An additional winding 72 which may be connected in parallel or shunt with the main winding 66, and a magnetic switch 74 may be added to the main path, as shown, so that more complex regulation of the reactor 60 may be provided.

Figures 6A, 6B, 7A, 7B, 8A, 8B:
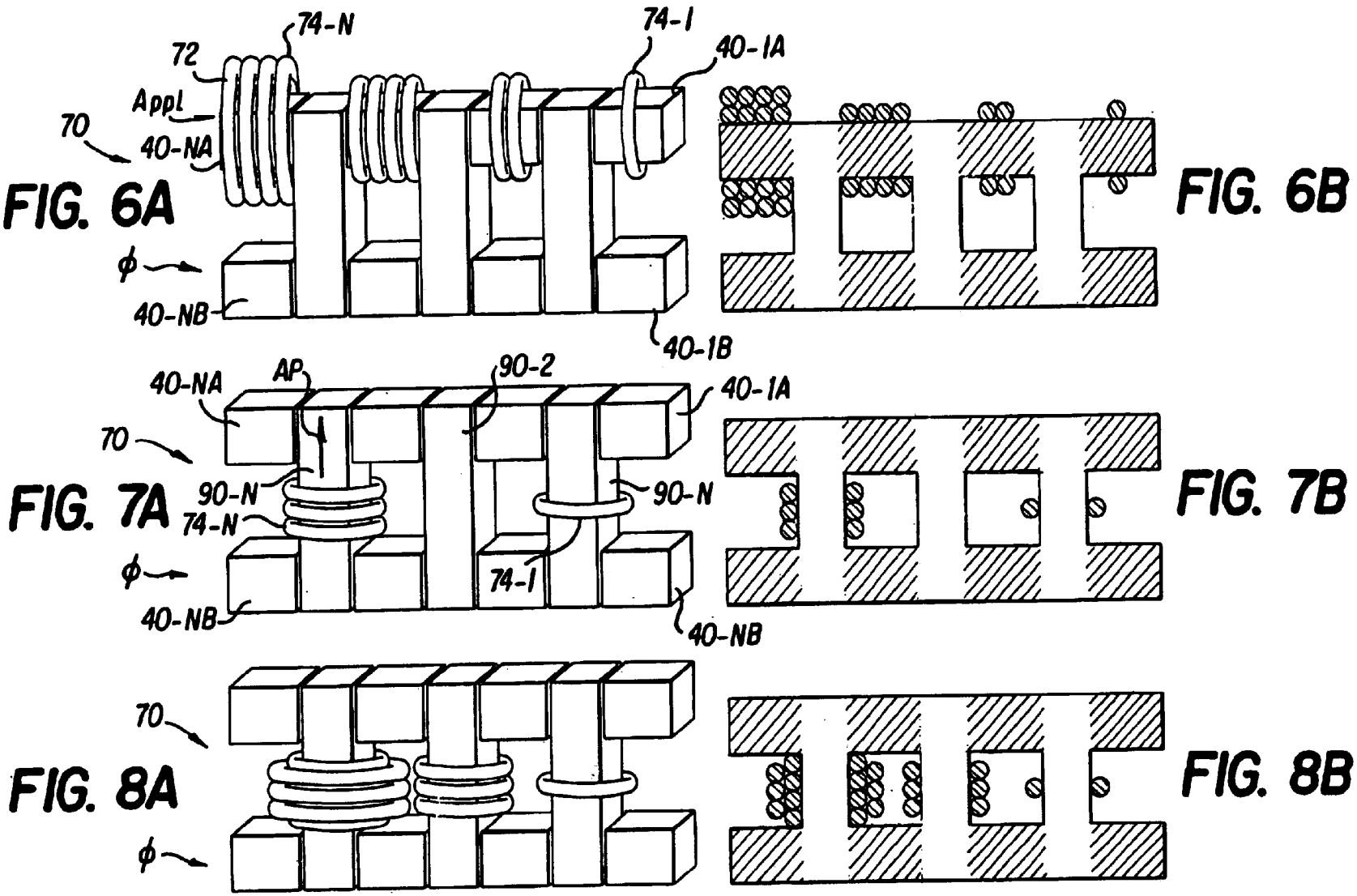
FIGS. 6A and 6B are respective, perspective and sectional schematic illustrations of a device in accordance with an embodiment of the present invention.
FIGS. 7A and 7B are respective, perspective and sectional schematic illustrations of a device in accordance with another embodiment of the invention.
FIGS. 8A and 8B are respective, perspective and sectional schematic illustrations of a device in accordance with yet another embodiment of the invention.

FIGS. 6A–6B; 7A–7B; and 8A–8B illustrate the regulation portion 70 of a transformer, reactor or regulator, as the case may be, depending on the application. The regulation winding 72 having $N_R$=4 turns is divided into spatially well separated subcoils 74-1 . . . , 74-n having N1 . . . n terms where N1=3 and n=1. Regulation is achieved by linking the magnetic flux past or through each such sub-coil 74 to omit, add, or subtract its corresponding number of turns, $n_i$, to the total number of regulation turns, $N_R$.

Three regulation winding arrangements of interest can be identified and are named after the first three elements in the sequence of subcoil turn rations: 1:2:4, 1:3:7, and 1:3:9, respectively. The arrangements are restricted to a construction with 2×4 magnetic switches. Each of these arrangements is illustrated in FIGS. 6A–6B; 7A–7B; and 8A–8B respectively as follows.

FIGS. 6A–6B illustrate a 1:2:4 arrangement. The winding 72 in the form of a cable discussed above in FIG. 2 is wound around a common axis $A_{pp1}$ parallel to the direction of the main magnetic flux $\phi$ and with one magnetic switch 40-1A in 40 NA inside each sub-coil 74-1 in 74-n and one switch 40-1B in 40 NB outside each coil. The number of turns is doubled for each coil in the sequence, i.e., $n_i=2^{i-1}$, i=1,2,3, . . . , $n_1$=1,2,3, . . . The magnetic flux can pass through a coil in just one direction. Accordingly, turns can be omitted or added, but not subtracted. The number of switches 40 required is 2m, where m is the number of subcoils, and the number of possible regulation levels in $2^m$. FIGS. 2A, 6A–6B show sixteen possible values of $N_r$:

0,1,2,3(=2+1), 4,5(=4+1), . . . , 15(=8+4+2+1).

FIGS. 7A–7B illustrate a 1:3:9 arrangement. The cable is wound around A d alternate legs 90-1 . . . , 90-n with axes AP, perpendicular to the main magnetic flux direction. Every second leg 50-2 . . . , 50-(N–1) is left unwound as a bridge between the upper and the lower horizontal part of the core. The number of turns is tripled for each sub-coil 74-1 . . . , 74-n in the sequence; $n_i=3^{i-1}n_1$. Switches 40-1A, 40-1B . . . , 40-NA, 40-NB are positioned on the sides of each leg so that the flux ma be linked past or in both directions through a sub-coil 38-1 . . . 38-n. The number of switches required is 4m and the number of possible regulation levels is $3^m$. FIGS. 7A–7B show an example with nine possible values of $N_R$:

−4(=−3−1), −3, −2(=−3+1), −1, 0, 1, 2(=3−1), 3, 4(=3+1).

FIGS. 8A–8B illustrate a 1:3:7 arrangement. The cable is wound around legs 94-1 . . . , 94-n with axes AP perpendicular to the main magnetic flux direction. In contrast to the 1:3:9 case above all legs 94-1 . . . 94-n are wound. The number of turns is approximately doubled for each sub-coil 38 in the sequence; $n_i=(2^i-1)n_1$. Switches 40-1 A, 40-1B . . . , 40-NA, 40-NB are positioned on the sides of each leg so that the flux may be linked past or in both directions through sub-coil 5 74-1 . . . , 74-n, with the restriction than in a sequence of incorporated coils, turns are added with alternating sign. The number of switches required is 2m+2 and the number of possible regulation levels is $2^{m+1}1$. FIGS. 8A–8B show an example with fifteen possible values of $N_R$:

−7,−6(=−7+1), −5(=−7+3−1), −4(=−7+3), −3−2(=−3+1), −1,0,1,2(=3−1), 3,4(=7−3), 5(=7−3+1), 6(=7−1), 7.

Thus, in accordance with the invention, a selectable static induction device has been provided in which one or more magnetic switches selectively open and close flux paths in the device. It should be understood that in addition to the short circuit rings described, providing a step function like flux response, variable impedances of various kinds may be used. For example, if a variable inductor is used to load a ring 40, the reluctance varies inversely with the inductance. Thus, high inductive loading will result in a corresponding high flux distribution in the leg. If a variable capacitance is used, reluctance varies directly. If a variable or high resistance is used as a load for the ring 40, a variable or high flux distribution results in the leg. If the ring is shorted, the effect is as described in that the flux will be blocked. Various combinations of fixed and variable, real and reactive loading may also be provided. In addition, loading or activation may be provided by an active element, for example, an active filter. Such a filter could be programmable.

It is also possible to provide a variable power source, e.g., a voltage or current source to produce an input on the ring which is adapted to modulate the flux in the leg. Modulation may be in terms of amplitude, phase and frequency. It is also possible to provide an active filter to load the ring to thereby vary the performance of the ring and thus modulate the device output.

Figure 9:
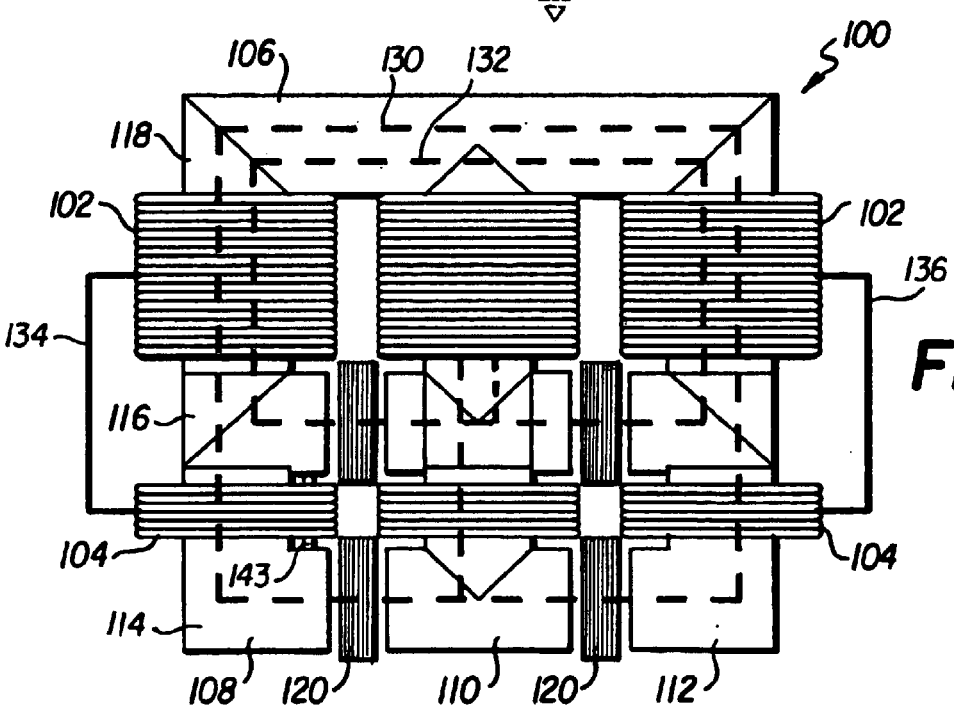
FIG. 9 is a schematic illustration of a three phase transformer according to the invention.

FIG. 9 illustrates another embodiment of the invention wherein a three phase transformer 100 of a shell or core type having a main winding 102 and a regulation winding 104 for each phase wrapped on a core 106 is illustrated. The various flux paths are shown in dotted line in the legs 108, 110 and 112 and the yokes 114, 116 and 118. According to the invention, a one or more magnetic switches 120 may be employed as hereinabove described. In the exemplary embodiment shown, switches 120 are located in yokes 114 and 116 to control the flux through the regulation windings 104. The windings may be in series or shunt as may be the flux bearing paths. For example, flux path 130 forms a closed series outer loop and flux path 132 forms a closed series inner loop which is parallel to path 130. The coils 102 and 104 may be connected in a variety of series or parallel arrangements by appropriate connection of the leads 134 and 136 as is known by those skilled in the art.

The magnetic switches 120 surround regions 144 in the core 106 which may be formed of a conductive material or may be formed of a solid insert of material different from the core material having reduced or low magnetic permeability or an air gap. Also, one or more spacers 143 may be provided between the yokes 114 and 116. Further details of such arrangements may be seen in U.S. patent application Ser. No. 08/980,210 incorporated herein by reference.

While there have been provided what are considered to be exemplary embodiments of the invention, it will be apparent to those skilled in the art that various changes and modifications therein may be made without departing from the invention, and it is intended in the appended claims to cover such changes and modifications as fall within the true spirit and scope of the invention.

We claim:

1. A static high power electromagnetic device comprising:

at least one main winding configured to handle high power for producing a flux when energized comprising at least one current-carrying conductor and a magnetically permeable, electric field confining, covering surrounding the conductor, including an inner layer having semiconducting properties surrounding the conductor, a solid insulating layer surrounding the inner layer and an outer layer having semiconducting properties surrounding the insulating layer;

at least one secondary winding in operative relationship with the main winding for producing a corresponding flux when energized;

a flux bearing region for the flux of the main winding; and control means in operative relationship with the flux bearing region for selectively controlling the flux in the flux bearing region.

2. The electromagnetic device according to claim 1, wherein the control means is operable in first and second states, said first state is operative for admitting flux in the flux bearing region and the second state is operative for blocking flux in the flux bearing region.

3. The electromagnetic device according to claim 1, wherein the control means includes switching means for operating the control means in the first and second states.

4. The electromagnetic device according to claim 1, wherein the control means comprises a winding having terminals and at least one turn surrounding the flux bearing region, and a switch coupled to the terminals for opening and closing the winding.

5. The electromagnetic device according to claim 1, wherein the control means comprises at least one conductive ring surrounding the flux bearing region and means for switching the ring into and out of operative relationship therewith for selectively blocking and admitting the flux therein.

6. The electromagnetic device according to claim 1, wherein the flux bearing region comprises at least two selectable flux paths.

7. The electromagnetic device according to claim 1, wherein the flux bearing region comprises a main flux path for the main winding and at least one selectable flux path in operative relation with said at least one regulation winding.

8. The electromagnetic device according to claim 1, wherein the flux bearing region comprises a main flux path for the main winding and a selectable flux path for each regulation winding.

9. The electromagnetic device according to claim 1, wherein the at least one regulation winding includes a plurality of subwindings, and the flux bearing region comprises a main flux path for the main winding and a selectable flux path for each subwinding.

10. The electromagnetic device according to claim 1, wherein the subwinding includes windings having turns in at least one of a ratio of 1:2:4; 1:3:7; and 1:3:9.

11. The electromagnetic device according to claim 1, wherein the flux bearing region includes a main flux path for the main winding having a main flux direction and at least one selectable flux path having an orientation in at least one of a direction perpendicular and parallel to the main flux path.

12. A device according to claim 1, wherein the covering comprises at least one solid insulating layer surrounding the conductor and at least one partially conductive layer surrounding the conductor.

13. The device according to claim 1, further wherein the flux bearing region is magnetizable and is in operative relationship with the main winding and the regulation winding.

14. A device according to claim 1, wherein the magnetizable flux bearing region in operative relationship with the main winding and the regulation winding includes at least one of a shell and core.

15. A device according to claim 1, further including a selectable region of relatively high reluctance in the flux bearing region in operative relationship with at least one of the main winding and the regulation winding.

16. A device according to claim 1, wherein the main winding and the at least one regulation winding are in at least one of a shunt and series relationship.

17. A device according to claim 1, including a magnetic circuit having at least one of serial and parallel paths and wherein the at least one regulation winding is located in at least one of said serial and parallel paths.

18. The device according to claim 1, wherein the control means comprises at least one of active and passive impedances.

19. The device of claim 18, wherein the impedances comprise a reactive impedance.

20. The device according to claim 18, wherein the impedance comprises a real impedance including at least one of an open circuit, a short circuit, and a resistance in operative relationship with the at least one regulation winding.

21. The device according to claim 1, wherein the main winding comprises a flexible cable.

22. A device according to claim 1, wherein the inner layer surrounding the conductor having semiconducting properties; is in electrical contact with the conductor; the solid insulating layer is in intimate contact with the inner layer; and the outer layer having semiconducting properties is in intimate contact with the insulating layer.

23. A device according to claim 22, wherein the inner layer is in electrical contact the conductor and is operative at the same potential thereof.

24. A device according to claim 22, wherein the outer layer comprises an equipotential surface surrounding the insulating layer.

25. A device according to claim 22, wherein the outer layer is connectable to at least one selectable potential.

26. A device according to claim 25, wherein the selected potential is ground.

27. The device according to claim 25, wherein at least one of said semiconducting layers has substantially the same coefficient of thermal expansion as the insulating layer.

28. A device according to claim 25, wherein the cover is substantially void free.

29. A device according to claim 25, wherein each semiconducting layer has a contact surface in confronting relationship with the corresponding surfaces of the insulating layer and wherein said contacting surfaces are joined therealong.

30. A device according to claim 25, wherein the covering is formed of at least one polymeric material.

31. A device according to claim 1, wherein the main winding comprises a transmission line cable.

32. A device according to claim 31, wherein the cable is manufactured with a conductor area which is between about 30 and 300 $mm^2$ and with an outer cable diameter which is between about 20 and 250 mm.

33. A device according to claim 1, wherein the covering comprises an extruded solid insulation.

34. A device according to claim 1, wherein the at least one current-carrying conductor comprises at least one insulated strand and at least one uninsulated strand.

35. A device according to claim 34, wherein the at least one uninsulated strand is arranged in electrical contact with the covering.

36. A device according to claim 1, wherein the flux bearing region includes a zone of reduced permeability comprising at least one of an air gap and a conductive element and solid inserts of a material with low permeability.

37. A device according to claim 36, wherein said zone of reduced permeability comprises cavities formed in said conductive element.

38. A device according to claim 1, including a core comprising a main leg and at least two sub-legs, at least one of the sub-legs forming a leg for the regulation winding.

39. A device according to claim 1, including a core comprising a main leg and at least two sub-legs.

40. A device according to claim 1, wherein said device comprises a multiphase transformer having a regulation leg in each phase, wherein the at least one regulation winding includes at least one winding for each regulation leg and being connected for having joint regulation.

41. A device according to claim 1, wherein said device comprises at least one of an autotransformer and a booster transformer.

42. A high power variable inductance device comprising:

a magnetic circuit including a flux path;

a main winding surrounding a first portion of the flux path;

at least one regulation winding surrounding the flux path; wherein at least one of said windings comprises a current-carrying conductor and a magnetically, permeable, electric field confining covering surrounding the conductor, including an inner layer having semiconducting properties surrounding the conductor, a solid insulating layer surrounding the inner layer and an outer layer having semiconducting properties surrounding the insulating layer; and magnetic switch means in operative relationship with the flux path, operable when energized, for selectively varying the flux in the flux path between open and closed states.

43. The device of claim 42, wherein the switch means comprises at least one conductive turn surrounding the flux path and a switch for opening and closing the turn.

44. The device of claim 43, wherein the control means includes an impedance comprising at least one of a reactive and real impedance.

45. The device of claim 44, wherein the reactive impedance includes at least one of a capacitive and inductive load.

46. The device of claim 44, wherein the impedance is variable.

47. The device of claim 44, wherein the impedance is a short circuit.

48. The device of claim 42, wherein the switch means includes at least one of an active and passive filter.

49. The device of claim 42, wherein the switch means includes a power source including means for varying at least one of the amplitude, frequency and phase of the flux in the flux path.

50. A high power variable inductance device comprising:

a magnetic circuit including a flux path having selectively variable flux bearing properties;

at least one main winding in operative relation with the flux path;

at least one regulation winding surrounding the flux path wherein at least one of said windings comprises a current-carrying conductor and a magnetically permeable, electric field confining covering surrounding the conductor, including an inner layer having semiconducting properties surrounding the conductor, a solid insulating layer surrounding the inner layer and an outer layer having semiconducting properties surrounding the insulating layer; and control means coupled to the flux path operable when activated, for selectively varying the flux in the flux path.

51. The device of claim 50, wherein the flux path includes spacer means in the flux path.

52. The device according to claim 50, wherein the control means comprises a power source for producing at least one of amplitude, phase and frequency modulation for the regulation winding.

53. The device according to claim 50, wherein the flux path comprises a plurality of selectable flux bearing regions.

54. The device according to claim 53, wherein the control means includes switch means for selectively varying the flux between for respective on and off states.

55. The device according to claim 53, wherein the switch means includes a switch for controlling the flux in each regulation winding.

* * * * *